US007108209B2

(12) United States Patent
Kim

(10) Patent No.: US 7,108,209 B2
(45) Date of Patent: Sep. 19, 2006

(54) DEVICE FOR TREATING FOOD WASTES

(76) Inventor: Young Ki Kim, 430-18 Shinchon-ri, Jinbuk-myun, Habpo-gu, Masan-shi (KR)

( * ) Notice: Subject to any disclaimer, the term of this patent is extended or adjusted under 35 U.S.C. 154(b) by 0 days.

(21) Appl. No.: 11/177,554

(22) Filed: Jul. 8, 2005

(65) Prior Publication Data

US 2006/0169811 A1 Aug. 3, 2006

(30) Foreign Application Priority Data

| | | |
|---|---|---|
| Feb. 1, 2005 | (KR) | 10-2005-0009009 |
| Feb. 18, 2005 | (KR) | 10-2005-0013438 |
| Mar. 3, 2005 | (KR) | 10-2005-0017806 |
| May 27, 2005 | (KR) | 10-2005-0044982 |
| May 27, 2005 | (KR) | 10-2005-0044983 |

(51) Int. Cl.
*B02C 23/36* (2006.01)
*B02B 3/06* (2006.01)

(52) U.S. Cl. ..... 241/46.013; 241/260.1

(58) Field of Classification Search ..... 241/24.11, 241/46.013, 46.014, 46.016, 81, 100, 260.1
See application file for complete search history.

(56) References Cited

U.S. PATENT DOCUMENTS 5,129,590 A * 7/1992 Shinya ..... 241/46.013
5,335,866 A * 8/1994 Narao ..... 241/46.013
5,370,323 A * 12/1994 Narao ..... 241/46.013

FOREIGN PATENT DOCUMENTS

| | | | |
|---|---|---|---|
| JP | 354070660 A | * | 6/1979 |
| JP | 405229603 A | * | 9/1993 |
| JP | 405278802 A | * | 10/1993 |
| JP | 406254425 A | * | 9/1994 |

* cited by examiner

*Primary Examiner*—Faye Francis
(74) *Attorney, Agent, or Firm*—Ladas and Parry LLP

(57) ABSTRACT

The device for treating food wastes comprises a housing which includes a feeding port formed at an upper side of the same for feeding food wastes, a drainage port formed at one side of a lower surface of the same for discharging leachate separated from the fed food wastes, and a discharge hole formed at the other side of the lower surface of the same for discharging dehydrated remnants among the food wastes; an inner casing which is installed at a certain distance from an inner wall of the housing and includes a drainage net installed at an upper side for discharging water fed together with the food wastes, a drum which is installed at a center of the same and has a plurality of wall surface blades at an inner circumferential surface, and a dehydration net installed at a lower side of the same for discharging leachate; a grinding screw which is vertically installed at an inner side of the inner casing and includes a plurality of screw blades installed at an outer circumferential portion and contacting with a wall surface blade of the drum, and the dehydration net.

17 Claims, 18 Drawing Sheets

DEVICE FOR TREATING FOOD WASTES

BACKGROUND OF THE INVENTION

1. Field of the Invention

The present invention relates to a device for treating food wastes capable of significantly decreasing food wastes in such a manner that a device for treating food wastes is installed at a lower side of a drainage port of a kitchen sink for thereby dehydrating and grinding food wastes.

2. Description of the Background Art

Generally, a food waste treating device has a body formed of a feeding part for feeding food wastes, a discharge part for discharging food wastes, and a screw for grinding food wastes.

The Korean patent laid-open No. 240229 invented and filed by the applicant of the present invention discloses a conventional device for treating food wastes. As shown in FIG. 1, in the above conventional device 100 for treating food wastes, a grinding screw 102 is engaged at a drum body 106 having a cutting blade 107 and a drainage port 108. The food wastes are dehydrated in such a manner that the grinding screw 102 is rotated with respect to the drum body 106. A dehydrating cap 113 having a dehydrating port 11 for discharging only water and a discharge port (not shown) for discharging food remnant is screw-engaged at one side of the drum body 106. A cover 115 detachable at a filtering net 114 formed of a plurality of through holes is fixedly engaged at the other side of the same.

In the food waste treating device 100, the feeding part 116 is vertically installed while the grinding screw 102 is horizontally installed, so that food wastes are moved in a horizontal direction for thereby compressing and grinding the food wastes. Therefore, if flexible and smooth food wastes are fed, the remnants are not well moved and discharged. In this case, the remnants are discharged through the drainage port 108 in a colloid state together with leachate for thereby causing a water pollution problem. If hard foreign substances, which are not well ground by the grinding screw 102, are fed, the food waste treating device 100 is damaged, so that it is needed to repair the damaged food waste treating device 100.

In addition, as shown in FIG. 2, a certain shelf 60' is additionally needed so that a food waste box 60 is installed at the discharge port 13, and a certain engaging unit should be provided for engaging the food waste box 60 and the discharge port 13. In the conventional, it is impossible to know a discharge time of the food wastes because a user cannot check the amount of the food wastes.

SUMMARY OF THE INVENTION

Accordingly, it is an object of the present invention to provide a device for treating food wastes capable of overcoming the problems encountered in the conventional art wherein a drainage not is no blocked by food remnants, and it is possible to easily remove hard foreign substances without disassembling a food waste treating device even when hard foreign substances are fed.

It is another object of the present invention to provide a device for treating food wastes capable of discharging the ground food wastes in time and accurately separating food wastes and leachate for thereby minimizing water pollution and significantly decreasing food wastes.

It is further another object of the present invention to provide a device for treating food wastes capable of preventing the grinding, dehydration and remnant discharging functions from getting worse, and water is not leaked in a direction of a deceleration gear.

It is still further another object of the present invention to provide a device for treating food wastes according to the present invention in which a food waste box can be easily attached to or detached from a grinding and dehydrating unit, with the food waste box being installed at one side of the grinding and dehydrating unit designed to grind and dehydrate food wastes.

It is still further another object of the present invention to provide a device for treating food wastes in which a user can known a disposal time of food wastes using the weight of food wastes accumulated in a food waste box without checking the amount of food wastes stored in the food waste box.

To achieve the above objects, there is provided a device for treating food wastes comprising a housing which includes a feeding port formed at an upper side of the same for feeding food wastes, a drainage port formed at one side of a lower surface of the same for discharging leachate separated from the fed food wastes, and a discharge hole formed at the other side of the lower surface of the same for discharging dehydrated remnants among the food wastes; an inner casing which is installed at a certain distance from an inner wall of the housing and includes a drainage net installed at an upper side for discharging water fed together with the food wastes, a drum which is installed at a center of the same and has a plurality of wall surface blades at an inner circumferential surface, and a dehydration net installed at a lower side of the same for discharging leachate; a grinding screw which is vertically installed at an inner side of the inner casing and includes a plurality of screw blades installed at an outer circumferential portion and contacting with a wall surface blade of the drum, and the dehydration net, respectively, for transferring the food wastes in a downward direction and grinding, compressing and dehydrating the food wastes as it is rotated, for thereby discharging the dehydrated remnants through the discharge hole of the housing; and a driving unit which rotates the grinding screw.

There is further provided an inlet hole which is detachably engaged with a lower surface of the housing and communicates with the discharge hole of the housing at an upper side of the same for thereby guiding the dehydrated remnants; a discharge port which is formed at one side for discharging the remnants to the outside; and a discharge nozzle which is closely contacted with a lower side of the inlet hole at the other side and has a support plate for temporarily supporting the remnants not to move in a downward direction.

A discharge groove is formed at a lower surface of the housing for guiding the dehydrated remnants in a direction of the discharge hole of the housing as the grinding screw is rotated wherein the ends of the discharge groove is connected with the discharge hole of the housing as the depth of the discharge hole is getting deeper.

The food wastes are ground into small pieces while the food wastes are being moved in a downward direction, as the heights of the wall surface blades of the drum are getting lower in the downward direction.

The grinding screw includes an extrusion bolthole for extruding the grinding screw wherein the grinding screw is detachably engaged with the rotary shaft of the driving unit using a bolt.

There is further provided a feeding screw which is installed in the interior of the drainage net of the inner casing and includes a spiral wing which is formed at an outer circumferential portion and contacts with the drainage net of the inner casing for thereby guiding the fed food wastes in a downward direction of the inner casing.

A spiral direction of the feeding screw is opposite to the spiral direction of the screw wing of the grinding screw.

A drainage net protrusion formed at a lower side of the inner surface of the drainage net of the inner casing is engaged with a screw protrusion formed at an upper side of an outer surface of the screw wing of the grinding screw, so that as the grinding screw is rotated, the drainage net is rotated.

There is further provided a brush member which has a brush contacting with an outer surface of the drainage net.

There are further provided a rotation plate which is engaged with a lower surface of the grinding screw for thereby being rotated together with the grinding screw and has a discharge shoulder of the grinding screw, and a second discharge hole formed at a lower side of the discharge shoulder for thereby guiding the dehydrated remnants in a direction of the first discharge hole of the housing.

When the grinding screw is rotated, the rotation plate is rotated in cooperation with the grinding screw, and a brush contacting with an outer surface of the dehydration net is installed at an edge of the rotation plate so that water slurry or food debris attached to the net holes of the dehydration net are removed.

A pressure discharge path is formed at an inner bottom surface of the housing so that the pressure generated when compressing and dehydrating the food wastes is discharged through the drainage portion, not inputted into the interior of the driving unit.

There are further provided a storing unit which is installed at one side of the grinding and dehydrating unit for storing food remnants ground and dehydrated by the grinding and dehydrating unit; and an alarming unit for detecting the stored state of the food remnants in the storing unit based on the weight of the food remnants and informing a user of the stored state. The storing unit includes a collecting box which has a certain space therein for storing the food remnants; a collecting box cap which is detachably engaged at an upper side of the collecting box and seals the collecting box and has a receiving hole formed at one side of the same so that the food remnants pass through; and a discharge pipe which connects the food waste grinding and dehydrating unit and the collecting box cap and guides the food remnants to the collecting box.

A hinge shaft is installed at one side of the collecting box cap so that the storing unit is connected with the grinding and dehydrating unit and is supported thereby, and said hinge shaft is fixedly caught by a support part formed at an upper side of the driving means.

The discharge pipe includes an opening so that both sides of the discharge pipe are opened, with an opening of one side being communicated with a discharge port of the discharge nozzle, and with an opening of the other side being communicating with the receiving hole of the collecting box cap, and with the discharge pipe being made of a smooth rubber material.

The alarming unit includes a detector which is installed at one lower side of the grinding and dehydrating unit corresponding to the lower side of the collecting box for detecting the amount of the food remnants stored in the collecting box; and a control panel which is designed to inform a user of the stored state of the food remnants detected by the detector.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The construction and operation of a device for treating food wastes according to the present invention will be described with reference to the accompanying drawings.

Figure 1:
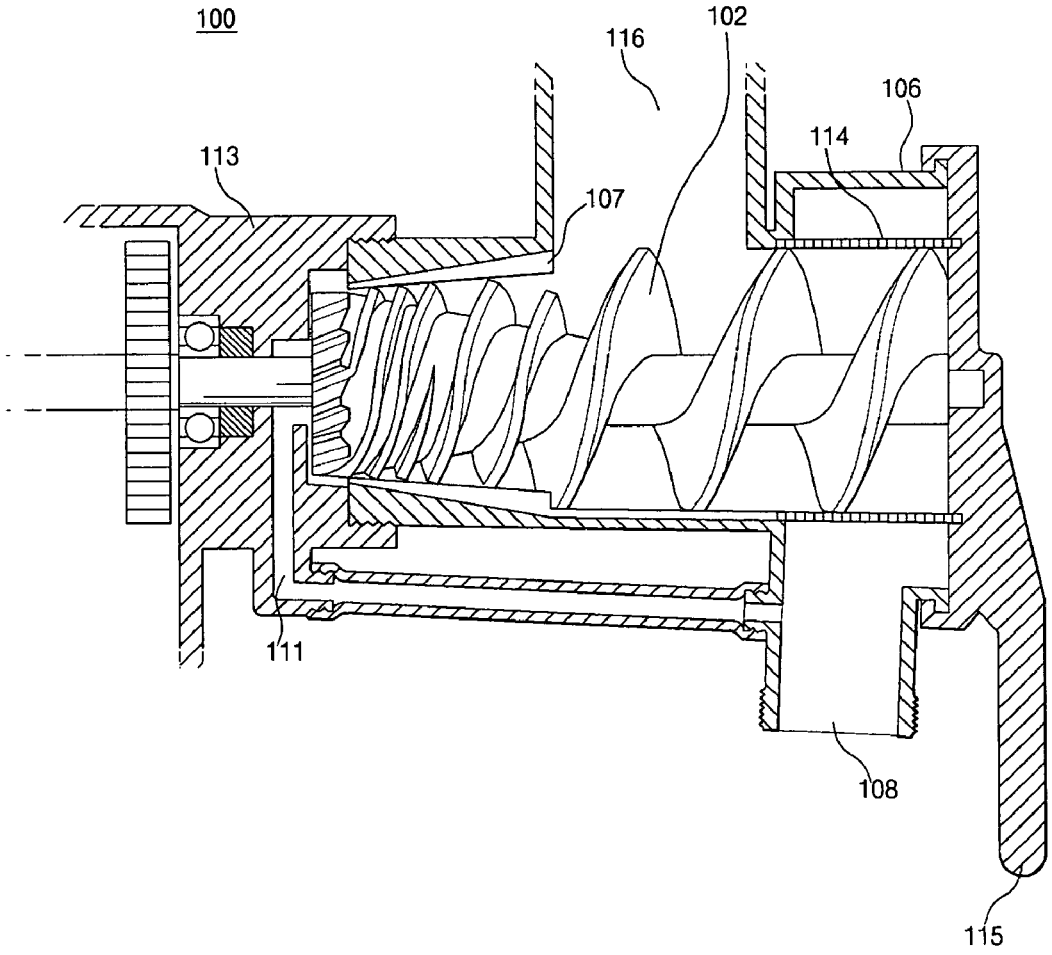
Fig.1 Prior Art
FIG. 1 is a cross sectional view illustrating a conventional device for treating food wastes.
Figure 2:
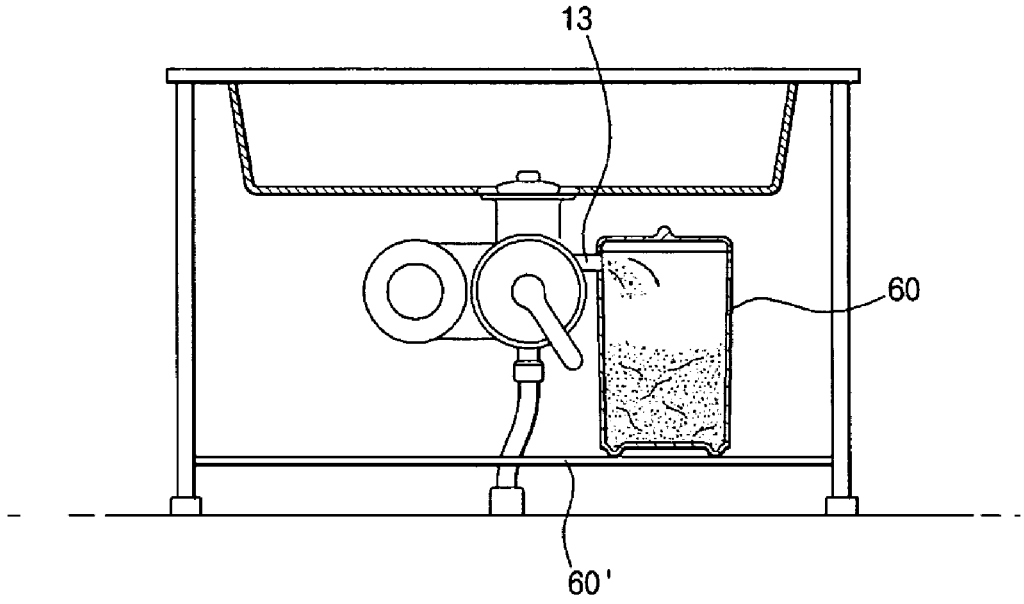
Fig.2 Prior Art
FIG. 2 is a view of a state of use of a conventional device for treating food wastes.
Figure 3:
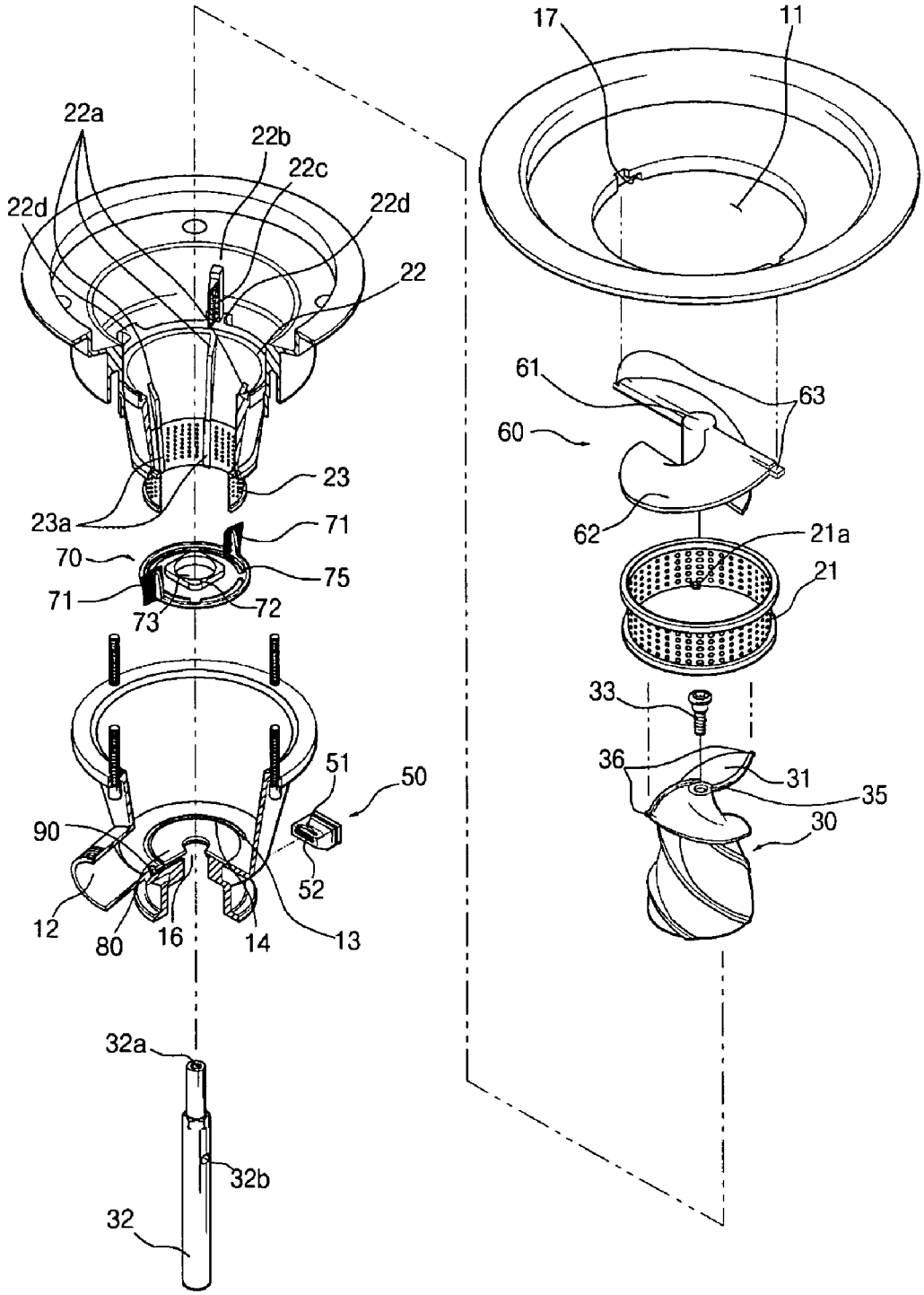
FIG. 3 is a partial cut-away and exploded view illustrating a device for treating food wastes according to the present invention.
Figure 4:
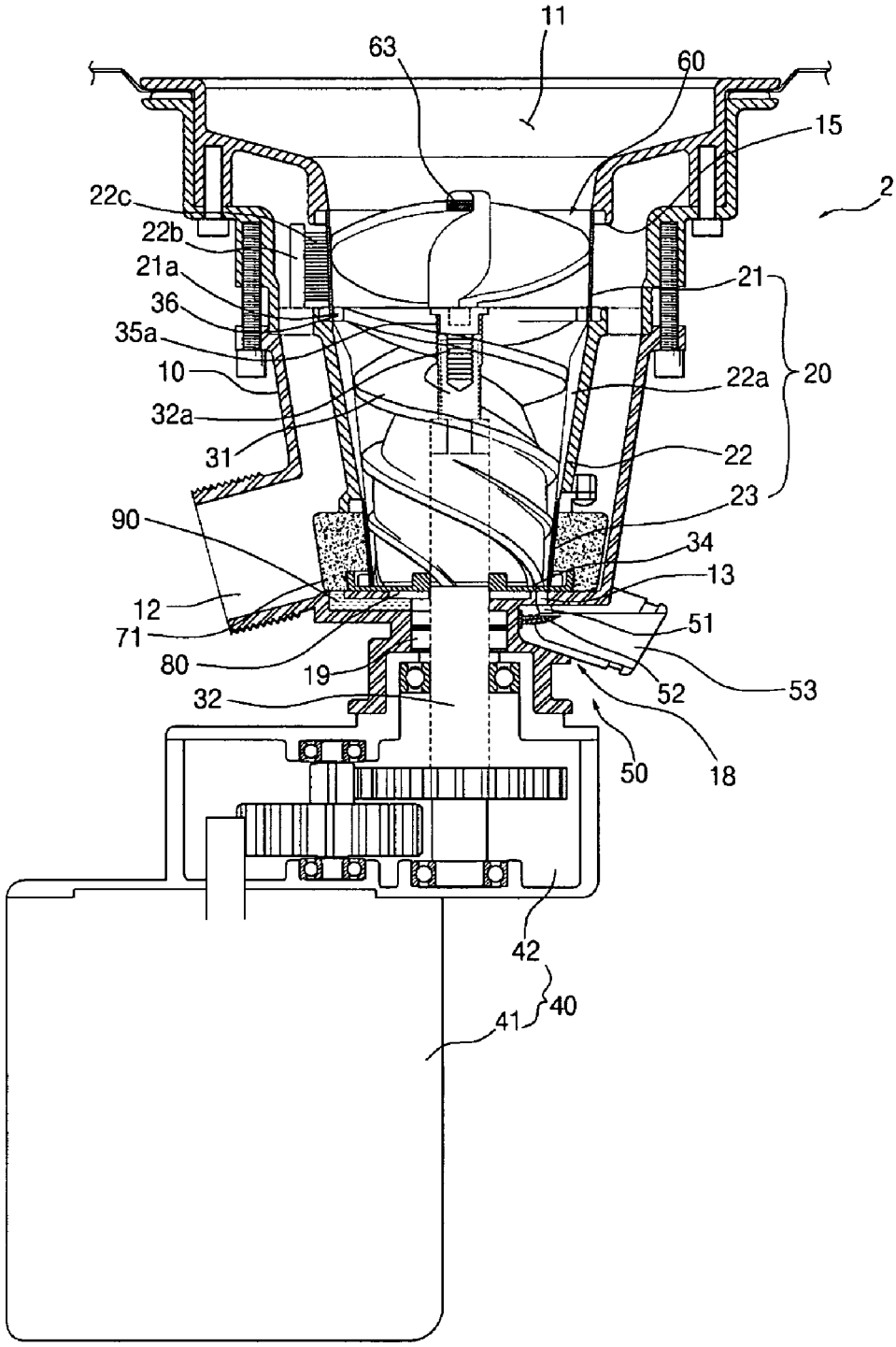
FIG. 4 is a cross sectional view illustrating a device for treating food wastes according to the present invention.
Figure 5A:
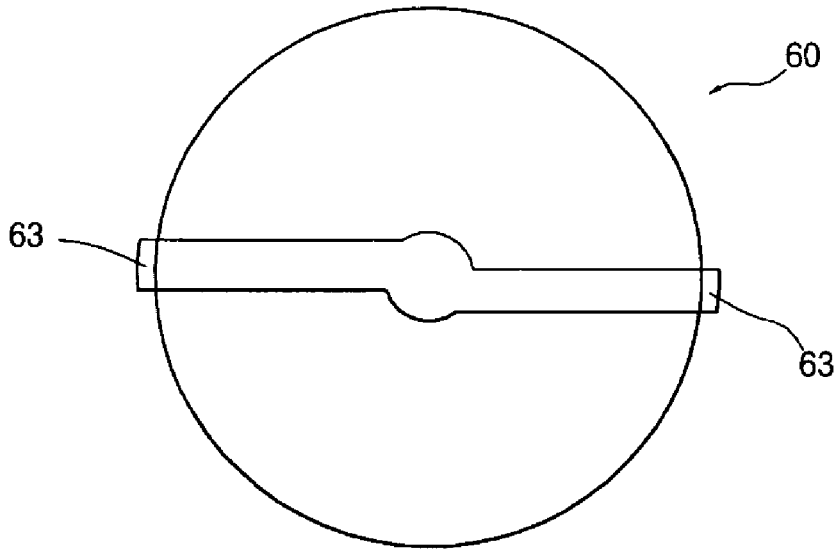
FIG. 5A is a plane view illustrating a feeding screw of a device for treating food wastes according to the present invention.
Figure 5B:
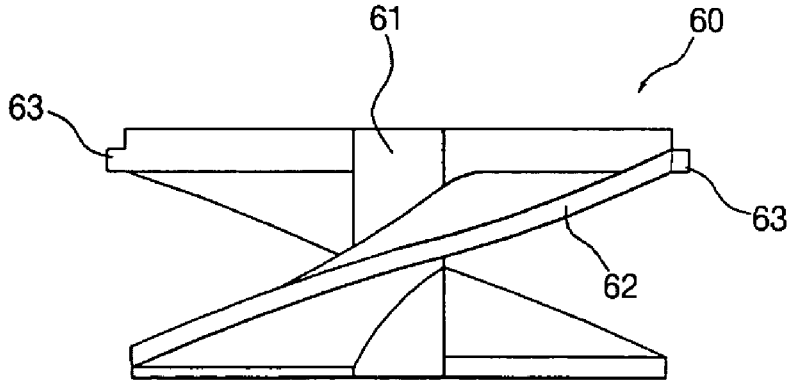
FIG. 5B is a side view illustrating a feeding screw of a device for treating food wastes according to the present invention.
Figure 6:
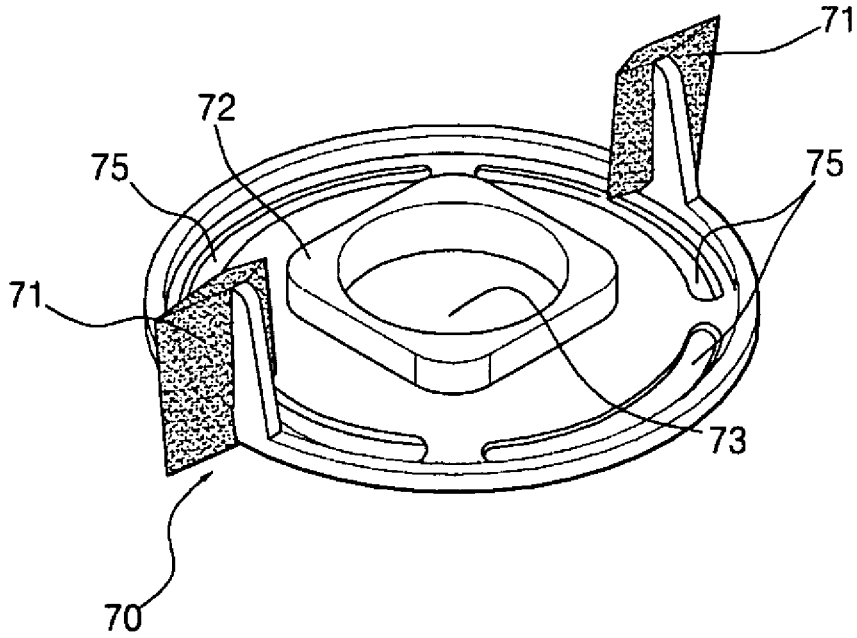
FIG. 6 is a perspective view illustrating a rotation plate of a device for treating food wastes.
Figure 7:
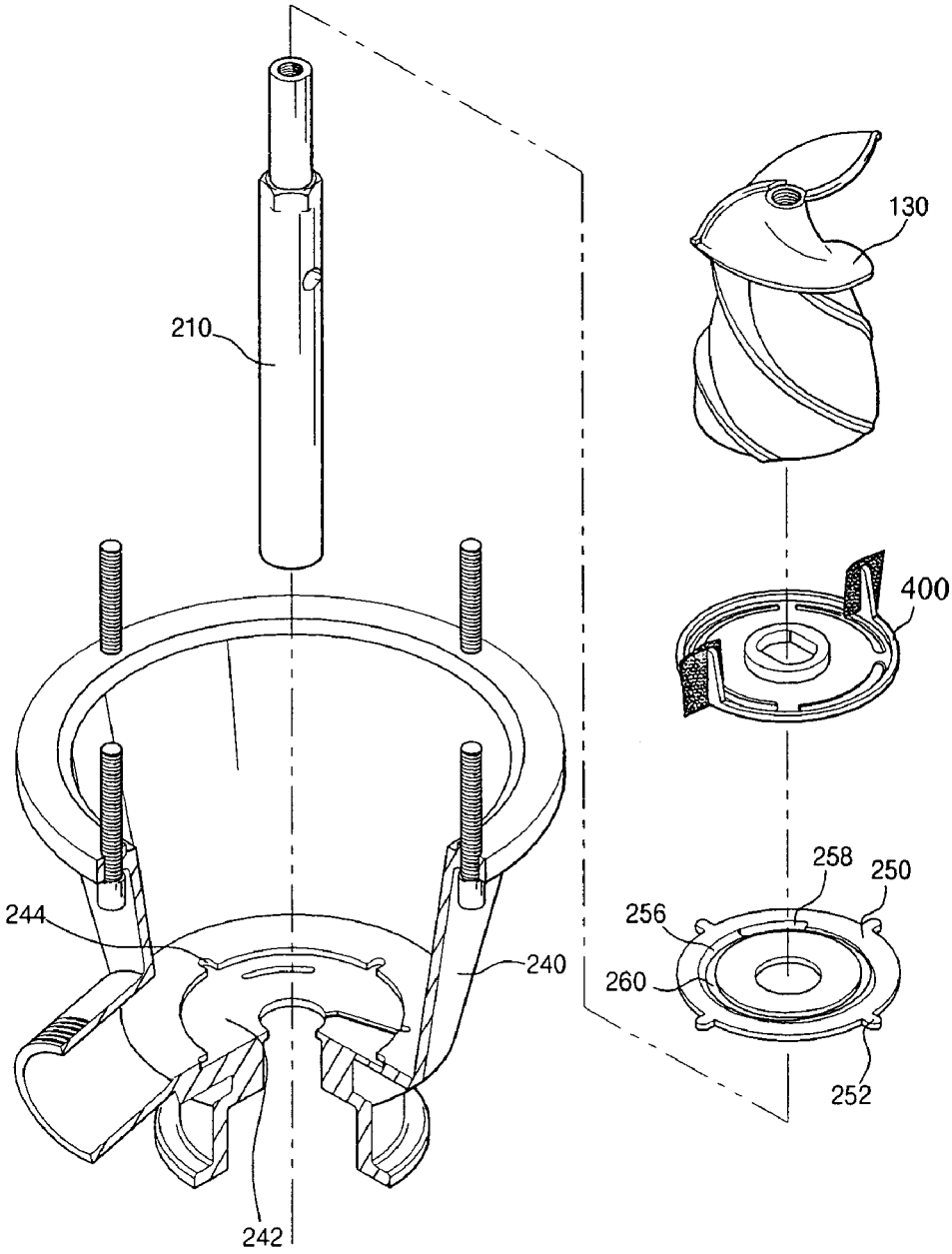
FIG. 7 is a perspective view illustrating key elements of a device for treating food wastes according to another embodiment of the present invention.
Figure 8:
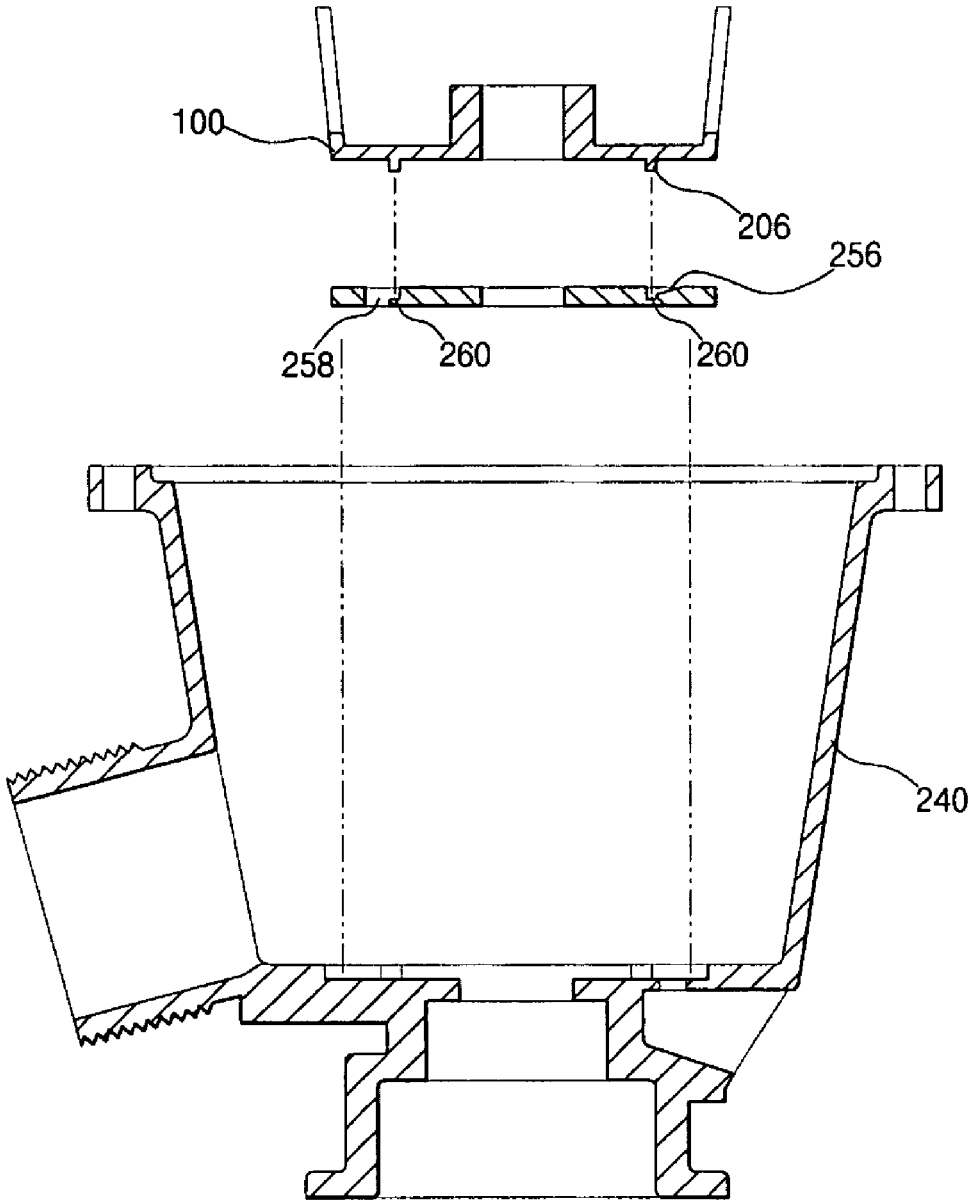
FIG. 8 is a cross sectional view of key elements of a device for treating food wastes according to another embodiment of the present invention.
Figure 9:
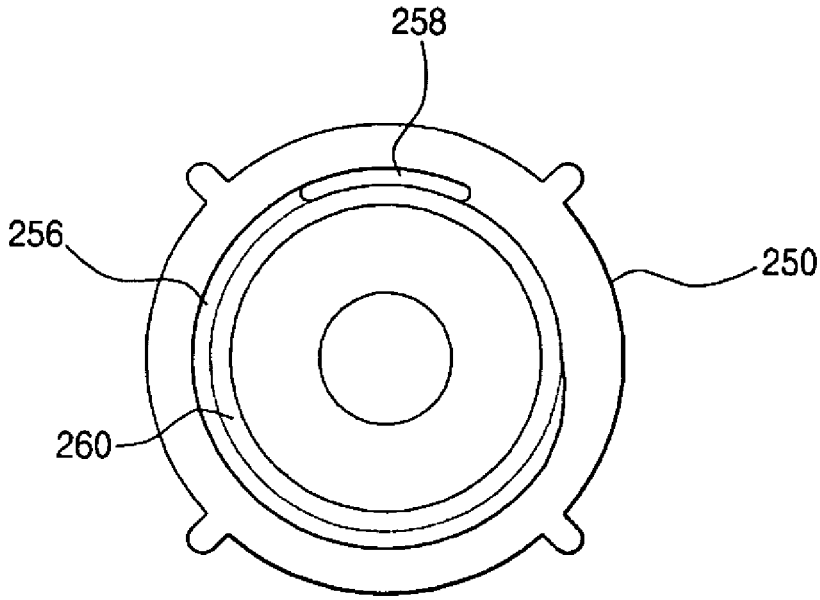
FIG. 9 is a plane view illustrating a bottom plate of a device for treating food wastes according to another embodiment of the present invention.
Figure 10:
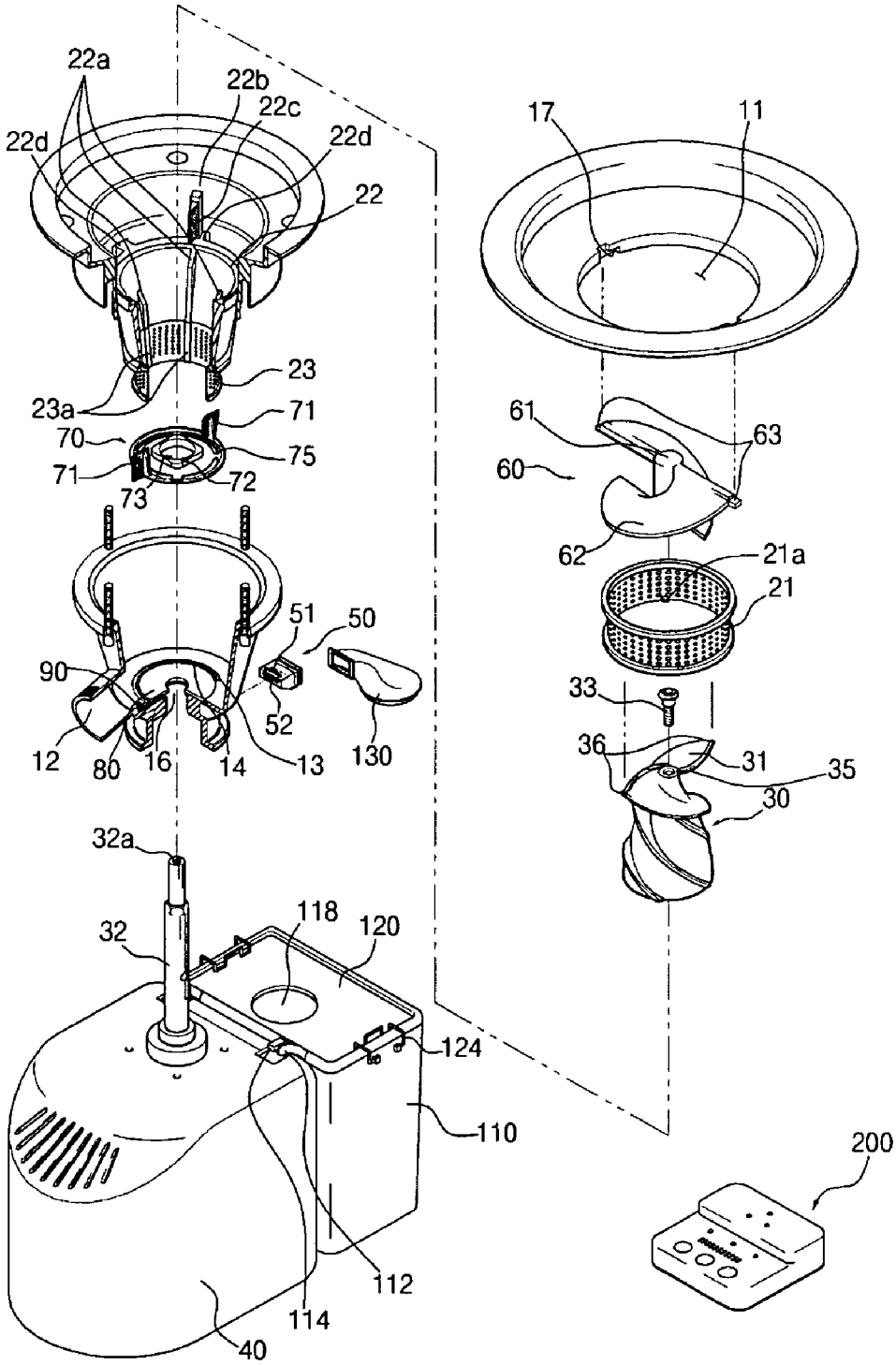
FIG. 10 is an exploded perspective view of a storing unit of a device for treating food wastes according to the present invention.
Figure 11:
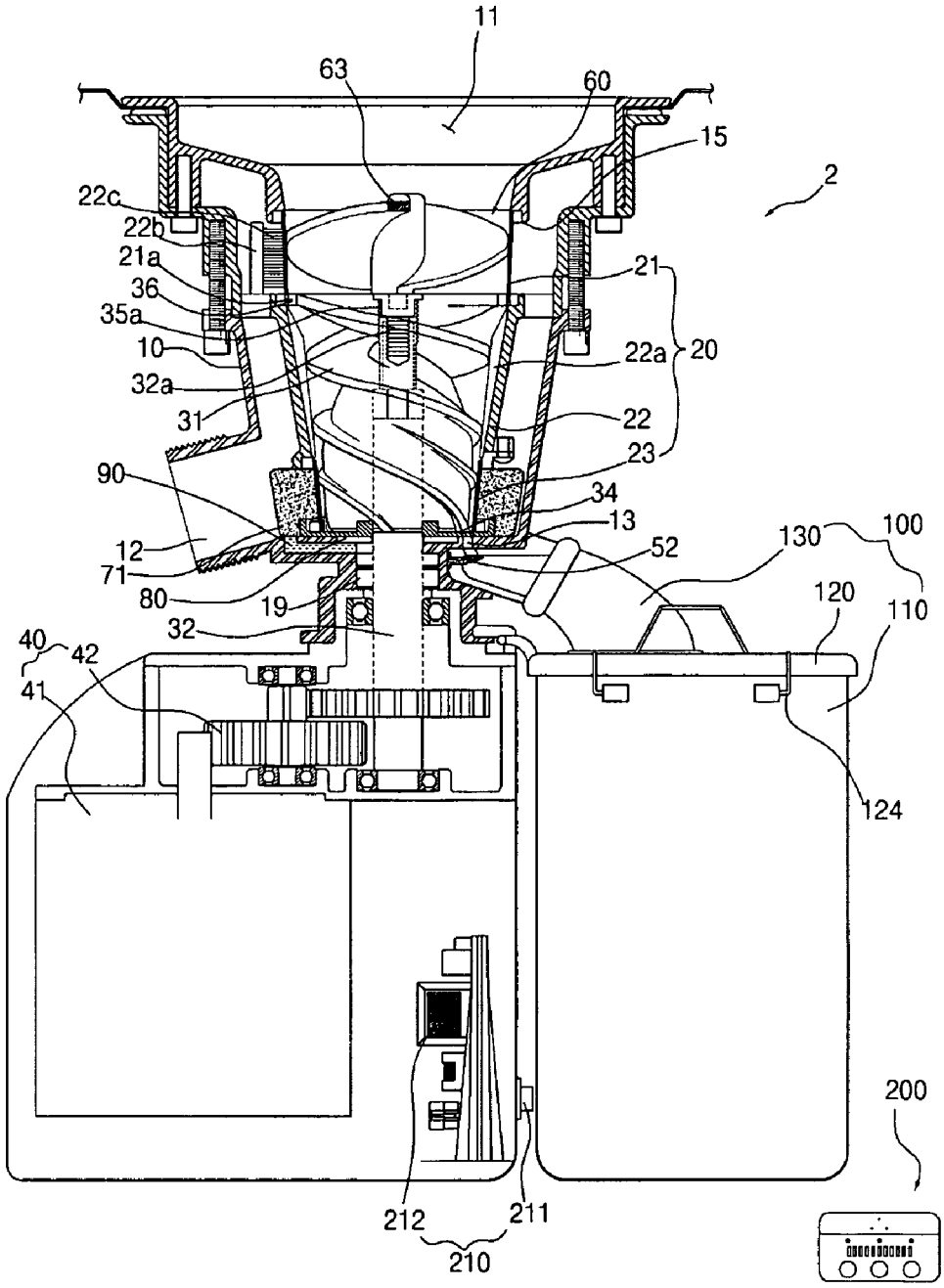
FIGS. 11 and 12 are plane views illustrating a storing unit of a device for treating food wastes according to the present invention.
Figure 12:
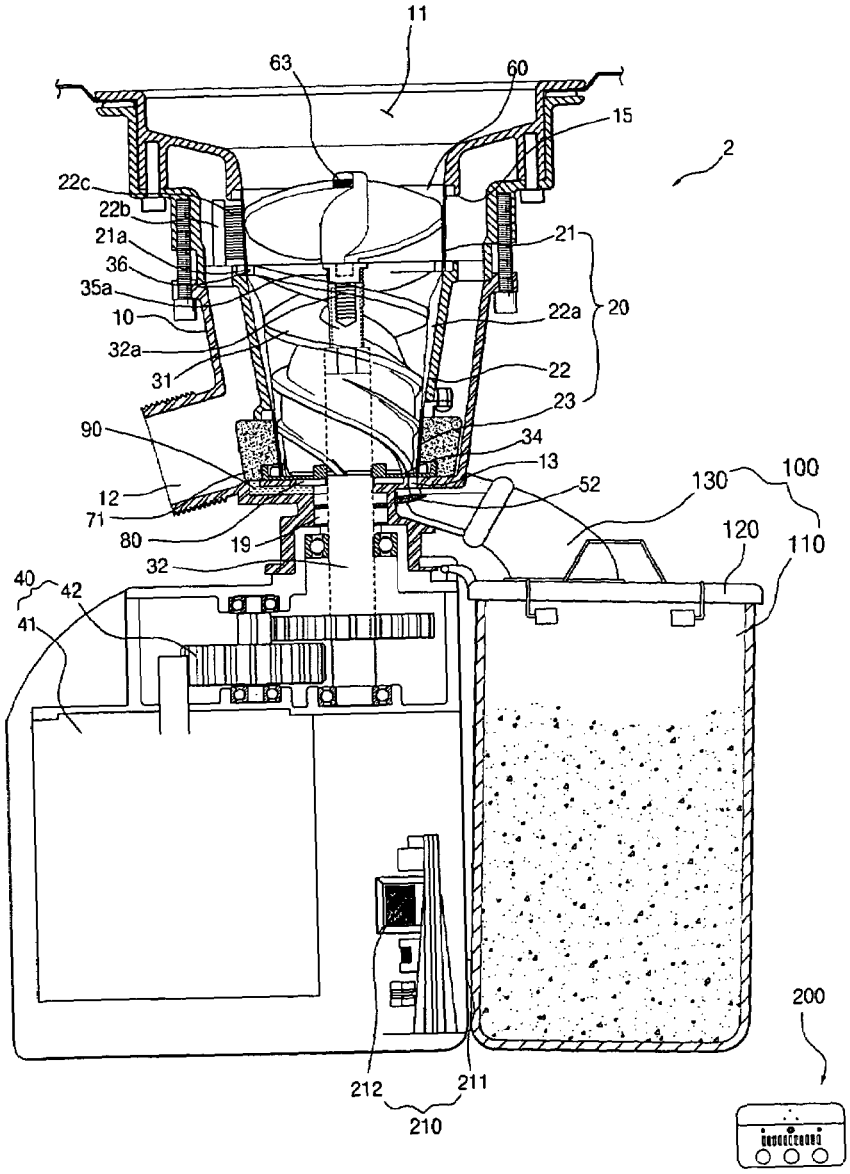
Figure 13:
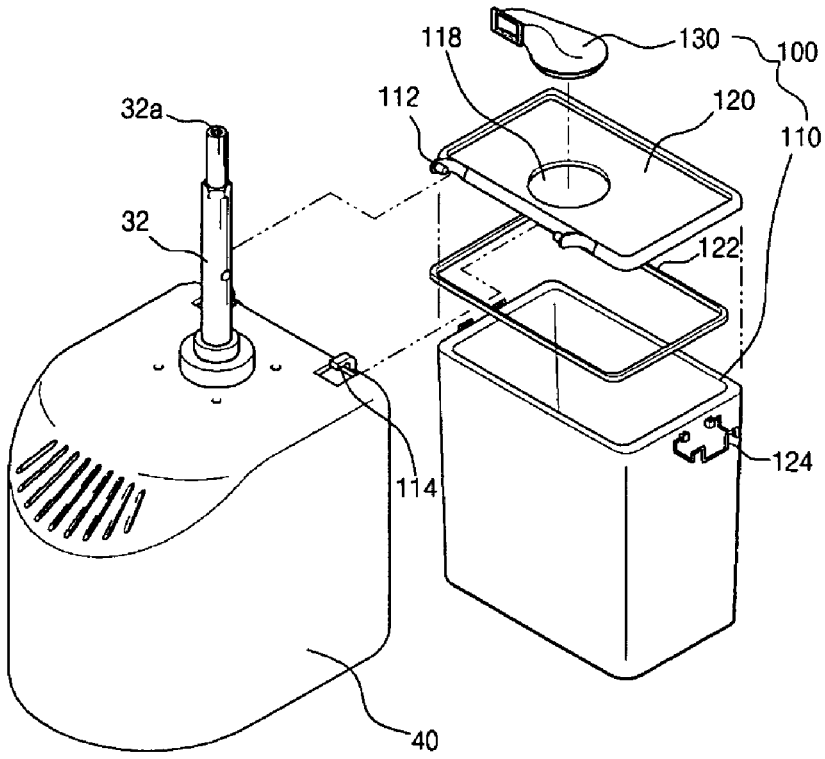
FIG. 13 is an exploded perspective view illustrating key elements of a storing unit of a device for treating food wastes according to the present invention.
Figure 14:
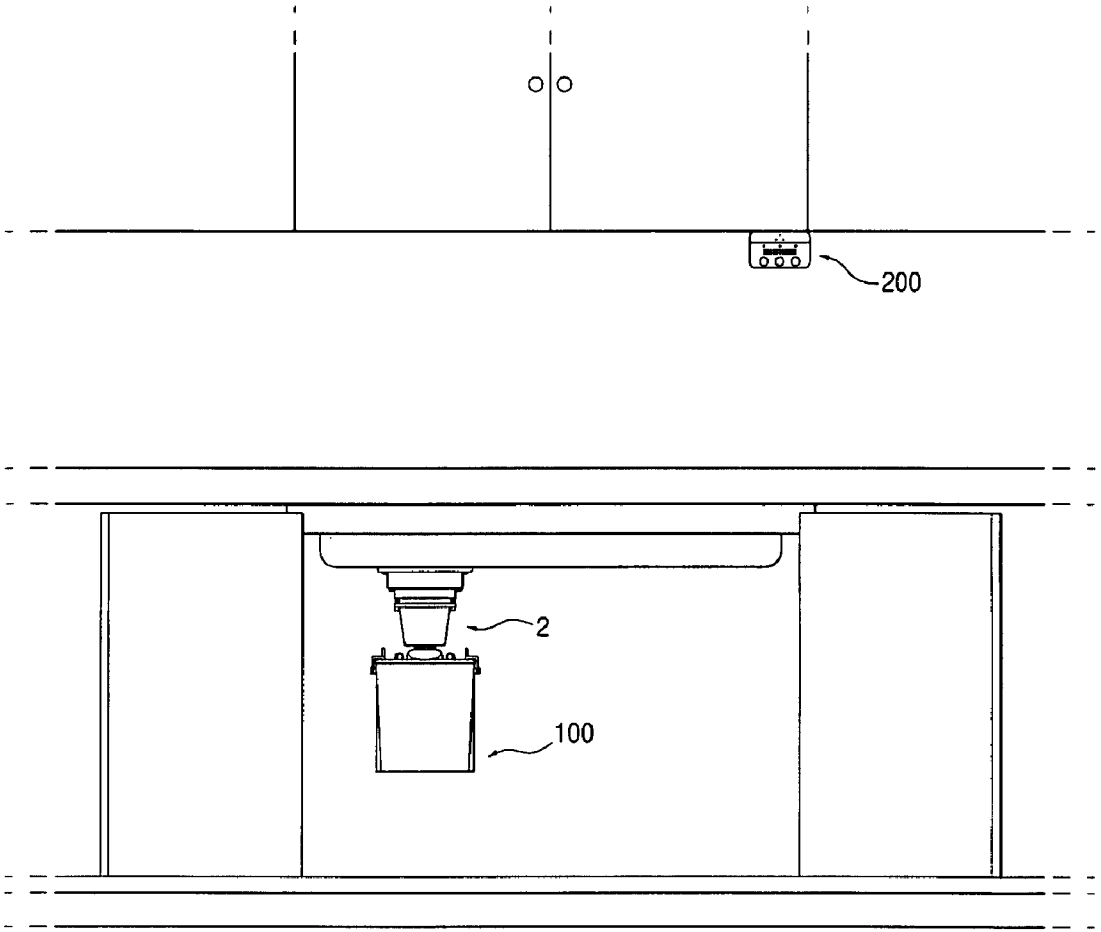
FIG. 14 is a view illustrating an installation state of a device for treating food wastes according to the present invention.

FIG. 1 is a cross sectional view illustrating a conventional device for treating food wastes; FIG. 2 is a view of a state of use of a conventional device for treating food wastes; FIG. 3 is a partial cut-away and exploded view illustrating a device for treating food wastes according to the present invention; FIG. 4 is a cross sectional view illustrating a device for treating food wastes according to the present invention; FIG. 5A is a plane view illustrating a feeding screw of a device for treating food wastes according to the present invention; FIG. 5B is a side view illustrating a feeding screw of a device for treating food wastes according to the present invention; FIG. 6 is a perspective view illustrating a rotation plate of a device for treating food wastes; FIG. 7 is a perspective view illustrating key elements of a device for treating food wastes according to another embodiment of the present invention; FIG. 8 is a cross is sectional view of key elements of a device for treating food wastes according to another embodiment of the present invention; FIG. 9 is a plane view illustrating a bottom plate of a device for treating food wastes according to another embodiment of the present invention; FIG. 10 is an exploded perspective view of a storing unit of a device for treating food wastes according to the present invention; FIGS. 11 and 12 are plane views illustrating a storing unit of a device for treating food wastes according to the present invention; FIG. 13 is an exploded perspective view illustrating key elements of a storing unit of a device for treating food wastes according to the present invention; FIG. 14 is a view illustrating an installation state of a device for treating food wastes according to the present invention; and FIGS. 15A through 15D are views illustrating the states of uses of a device for treating food wastes according to the present invention.

In the device for treating food wastes according to the present invention, there are provided a grinding and dehydrating unit 2 which grinds and dehydrates food wastes as a screw is rotated by a certain driving unit installed at a lower side when food wastes are fed from an upper side, and discharges only food remnants except for water fed together with food wastes and leachate generated from food wastes; a storing unit 100 which is installed at one side of the grinding and dehydrating unit 2 for storing the food remnants ground and dehydrated by the grinding and dehydrating unit; and an alarming unit 200 which is designed to detect when the food remnants are stored in the storing unit 100 by a certain amount and to inform the stored state to the user.

As shown in FIGS. 3 through 6, the grinding and dehydrating unit 2 includes a cylindrical hollow housing 10, a discharge nozzle 50 detachably engaged with a lower surface of the housing 10, a cylindrical hollow inner casing 20 which is installed within the interior of the housing 10 and has a drainage net 21 at an upper side, a feeding screw 60 which is installed within the interior of the drainage net 21 and feeds food wastes in a lower direction, a grinding screw 30 which is rotatably installed within the interior of the inner casing 20 and is designed to transfer, cut, compress and dehydrate the fed food wastes, a rotation plate 70engaged to a lower surface of the grinding screw 30, and a driving unit 40 which drives the grinding screw 30.

The housing 10 is installed at the drainage port of the kitchen sink and includes a feeding port 11 which is installed at the drainage port of the kitchen sink for feeding food wastes, a drainage port 12 for discharging leachate from the food wastes, a first discharge hole 13 for discharging ground and dehydrated food wastes, an inclined discharge groove 14 for achieving a smooth discharge of the ground and dehydrated food wastes to the first discharge hole 13, a first through hole 16 through which a rotary shaft 32 of a deceleration gear 42 passes, and an insertion groove 18 into which the discharge nozzle 50 is inserted.

Here, the feeding port 11 is formed at an upper side of the housing 10 in a circular shape. An insertion groove 17 is formed at both sides of the inner surface of the feeding port 11 in such a manner that the insertion groove 17 is vertically extended and then is extended in a circumferential direction of the feeding port 11 by a certain length so that a fixing protrusion 63 of a feeding screw 60 is inserted. A circular groove 15 is formed at a lower end of the inner surface of the feeding port 11 so that an upper end rim portion of a drainage net 21 of the inner casing 20 is inserted thereinto.

The drainage port 12 is formed at one lower side of the housing 10. The first discharge hole 13 is formed at one side of the lower surface of the housing 10 in a circular shape. The discharge groove 14 is formed at the other side of the lower surface of the housing 10 in a circular shape, and the formed depth is getting deeper, so that the end of the same is connected with the first discharge hole 13. Therefore, as the grinding screw 30 and the rotation plate 70 are rotated, the discharge groove 14 guides the ground and dehydrated food wastes to the first discharge hole 13 of the housing 10 for thereby achieving a better discharge of the ground food wastes.

In addition, the first through hole 16 through which the rotary shaft 32 of the deceleration gear 42 passes is formed at a center portion of the lower surface of the housing 10 in a circular shape, and an insertion groove 18 into which the discharge nozzle 50 is inserted is formed at one side of the lower surface of the housing.

The discharge nozzle 50 is detachably installed at the insertion groove 18. An inlet hole 51 communicating with the first discharge hole 13 is formed at an upper side of the discharge nozzle 50 so that the food wastes are fed from the first discharge hole 13 of the housing 10. A discharge port 53 is formed at one side for discharging food wastes to the outside. A support plate 52 is installed at a lower side of the inlet hole 51 for temporarily supporting the fed food wastes.

Here, the support plate 52 is made of an elastic material such as rubber, etc., so that the fed food wastes pass through the first discharge hole 13 and the inlet hole 51 and are loaded on the support plate 52 and temporarily block the first discharge hole 13 and the inlet hole 51. Therefore, the leachate is not discharged through the discharge port 53 of the food wastes, but discharged to the dehydrating net 23.

The inner casing 20 is extended in the downward direction from the feeding port 11 of the housing 10 and is a space in which the fed food wastes are ground, compressed and dehydrated by the grinding screw 30. The inner casing 20 is discharged from the inner wall of the housing 10 by a certain distance and includes a drainage net 21, a drum 22 and a dehydrating net 23.

Here, the drainage net 21 is formed in a hollow cylindrical shape and is installed at an upper side of the inner casing 20 and includes a plurality of net holes. The water fed together with the food wastes is first discharged through the net holes. The rim of the upper end of the drainage net 21 is rotatably inserted into the circular groove 15 formed at the lower end of the feeding port 11 of the housing 10. The rim of the lower end of the drainage net 21 is mounted at a step portion of the upper end of the drum 22. A drainage net protrusion 21*a* is formed at a lower side of the inner surface of the drainage net 21. A screw protrusion 36 of the grinding screw 30 is closely contacted on the same plane with the drainage net protrusion 21*a*, so that as the grinding screw 30 is rotated, the drainage net 21 is rotated.

The drum 22 is formed at a center portion of the inner casing 20 in a hollow cylindrical shape. A plurality of wall surface blades 22*a* are distanced at the inner surface at regular intervals and are vertically formed. The vertical wall surface blades 22*a* have heights by the protrusions from the inner surface for grinding food wastes into small pieces using the driving screw 30 as the food wastes are transferred in the downward direction of the inner casing 20 and are getting lower in the downward direction. In addition a part of the upper side of each the every next wall surface blades 22*a* is removed in a preferred embodiment. In addition, the drum 22 is fixedly engaged with the housing 10 using a plurality of legs 22*d*. A brush member 22*b* having a brush 22*c* contacting with an outer surface of the drainage net is installed at an upper surface of the leg 22*d*.

The dehydration net 23 is positioned at a lower side of the inner casing 20 and is formed in a cylindrical shape. A plurality of net holes smaller than the net holes of the drainage net 21 are formed at the cylindrical outer surface. The lower end of the dehydration net 23 contacts with the upper surface of the rotation plate 70. The leachate generated as the food wastes are compressed by the grinding screw is discharged through the dehydration net 23. In addition, an engaging shoulder 23*a* is formed at an extended line portion of the wall surface blade 22*a* in order to enhance a compression force capable of compressing the ground food wastes in the downward direction. The height of the engaging shoulder 23*a* is preferably lower than the height of the wall surface blade 22*a*.

The feeding screw 60 includes a circular column-shaped body 61, and a spring wing 62 installed at an outer surface of the circular column. The spiral direction of the wing 62 is opposite to the spiral direction of the screw wing 31 formed at an outer surface of the grinding screw 30. The fixing protrusion 63 is formed at one side of the upper portion of the wing 62 and is inserted into the insertion groove 17 formed at one side of the inner surface of the feeding pot 11. The fixing protrusion 63 is stably mounted after it is rotated by a certain angle. When the grinding screw 30 is rotated in the reverse direction, it is escaped from the mounted state.

The grinding screw 30 is positioned below the feeding screw 60 and is vertically installed in the interior of the inner casing 20. The grinding screw 30 is mounted on the upper surface of the rotation plate 70. A plurality of screw wings 31 having the spiral directions opposite to the spiral direction of the wing 61 of the feeding screw are formed at a circumferential portion of the same. A rectangular groove is formed at the lower surface of the grinding screw 30 so that a rectangular protrusion 72 of the rotation plate 70 is inserted thereinto. Therefore, when the grinding screw 30 is rotated by a driving unit 40, the rotation plate 70 is rotated in cooperation with the grinding screw 30.

A vertical shaft hole 35 is formed at the center of the grinding screw 30 so that the rotary shaft 32 of the deceleration gear 42 is inserted. An extrusion bolthole 35*a* is formed at an upper side of the shaft hole 35 for thereby easily separating the grinding screw 30.

The bolt 33 includes threads at a lower end of the same, and a head which is formed at the upper end of the same and includes a diameter larger than the thread. When the bolt 33 is thread-inserted into the shaft hole 35, the rotary shaft 32 of the deceleration gear 42 is fixedly engaged with the shaft hole 35 of the grinding screw 30.

The cross section portions of the screw wings 31 installed at a circumferential portion of the grinding screw 30 contact with the wall surface blade 22*a* of the inner casing 20 and the engaging shoulder 23*a* of the dehydration net 23. The screw protrusion 36 is formed at an upper side of a circumferential portion of the screw wing 31. The driving screw 30 grinds food wastes into small pieces in cooperation with the wall surface blade 22*a* of the drum 22 and compresses the ground food wastes in the downward direction in cooperation with the engaging shoulder 23*a* of the dehydration net 23.

The rim of the lower end of the grinding screw 30 is cut and positioned inside the second discharge hole 75 of the rotation plate 70. A triangle discharge shoulder 34 is formed at a lower end of the screw wing 31 and has a certain height slightly higher than the protrusion height of the lower side of the screw wing 31 so that the food wastes transferred toward the lower side of the dehydrating net 23 is discharged toward the discharge groove 14 of the housing 10.

The driving unit 40 is installed at a lower side of the housing 10 and includes a deceleration gear 42 and a driving motor 41 for transferring a driving force to the grinding screw 30. One side of the deceleration gear 42 is engaged with the rotary shaft of the driving motor 41, and the other side of the same is engaged with the rotary shaft 32. Therefore, the revolution (rpm) of the driving motor 41 is properly decreased by the deceleration gear 42, so that the grinding screw 30 can be controlled to rotate a lower speed.

The rotary shaft 32 of the deceleration gear 42 is formed in a polygonal shape, not in a circular shape, at its center in order to efficiently transfer a rotational force to the grinding screw 30. A nut hole 32*a* engaged with the bolt 22 is formed at the upper end of the rotary shaft 32.

The rotation plate 70 is formed of a circular plate having an outer diameter larger than the outer diameter of the lower end of the grinding screw 30 and is installed between the grinding screw 30 and the housing 10 and is engaged with a lower surface of the grinding screw 30. The rectangular protrusion 72 of the rotation plate 70 is inserted into the rectangular groove of the grinding screw 30 and is rotated together with the grinding screw 30. In addition, a second through hole 73 is formed at the center of the rectangular protrusion 72 so that the rotary shaft 32 is inserted into the second through hole 73. A second brush 71 contacting with an outer surface of the dehydration net 23 is vertically formed at one side of the edge of the rotation plate 70.

In addition, a donut-shaped abrasion prevention ring 80 made of a ceramic material is formed at the lower surface of the housing 10 contacting with the rotation plate 70 in order to minimize abrasion of the lower surface of the rotation plate 70 and the housing 10.

A pressure discharge path 90 is formed so that the pressure of a fluid generated as the food wastes are compressed at the dehydration net 23 is applied to the drainage port 12, not to the inner side of the deceleration gear 42. At this time, the pressure discharge path 90 passes from one side of the circumferential surface of the first through hole 16 above a waterproof packing 19 to a lower side of the housing 10 for thereby communicating with the bottom surface of the housing 10.

According to the device for treating food wastes according to another embodiment of the present invention, as shown in FIGS. 7 through 9, a ceramic bottom plate 250 is installed so that the lower side of the rotation plate 400 is prevented from being worn out. In this embodiment of the present invention, the housing 240 may be made using a synthetic resin material instead a metallic material, so that a fabrication time period and unit cost are decreased, and a small and compact size product can be manufactured.

A circular groove 242 having a certain depth is formed at a lower surface of the housing 240. A bottom plate 250 is inserted into the circular groove 242. In addition, a fixing protrusion 252 is formed at an outer circumferential portion of the bottom plate 250 so that the bottom plate 250 is fixed at the circular groove 242. In addition, a fixing groove 244 is further formed at an outer circumferential portion of the circular groove 242.

A through hole is formed at a center of the bottom plate 250, with a rotary shaft 210 being inserted into the through hole, and an arc shaped discharge groove 256 is formed at an outer circumferential portion of the through hole, and a first discharge hole 258 is formed to pass through the portion in which the formation of the discharge groove 256 stops.

In another embodiment of the present invention, the discharge groove 256 is formed deeper and deeper in the direction of the first discharge hole 258, with the left and right cross sections of the discharge groove 256 being inclined more and more inwards, so that a circular groove 260 having a certain depth is formed at an inner side of the discharge groove 256.

In addition, a circular protrusion 206 corresponding to the circular groove 260 is formed at a lower side of the rotation plate 400, so that the rotation plate 200 can rotate with respect to the bottom plate 250, with the circular protrusion 206 being inserted into the circular groove 260. Only an inclined surface of the discharge groove 256 is fixed, with an upper surface of the discharge groove 256 operating with a relative movement by the circular protrusion 206 for thereby more smoothly transferring the food remnants when the food remnants are moved through the discharge groove 256. Namely, one surface of the discharge groove is a fixed surface, and the other surface of the same is an operation surface capable of moving the food remnants.

As shown in FIG. 10, the storing unit 100 includes a rectangular collecting box 110 which is installed at one side of the grinding and dehydrating unit 2 for collecting the food remnants ground and dehydrated by the unit 2 and having a certain internal space for storing the food remnants therein; a collecting box cap 120 which is detachably installed at an upper side of the collecting box 110 and is designed to tightly cover the collecting box 110 and has a receiving hole 118 so that the food remnants pass through; and a discharge pipe 130 for guiding the food remnants toward the collecting box 110 by connecting the discharge nozzle 50 and the collecting box cap 120 of the grinding and dehydrating unit 2.

In addition, a hinge shaft 112 is installed at one side of the collecting box cap 120 so that the storing unit 100 is connected with the grinding and dehydrating unit 2 and is supported thereby. The hinge shaft 112 is caught and fixed by the support portion 114 formed at the upper side of the driving unit 40. The discharge pipe 130 has an opening so that the both sides of the same are opened, with the opening of one side communicating with the discharge port 53 of the discharge nozzle 50, and with the opening of the other side communicating with the receiving hole 118 of the collecting box cap 120. The discharge pipe 130 is preferably made of smooth rubber material.

A rubber packing 122 is installed between the collecting box 110 and the collecting box cap 120 so that bad smell from the food remnants cannot be spread to the outside. An engaging part 124 is installed at the both sides of the upper end of the collecting box 110 so that the collecting box 110 is detachable from the collecting box cap 120. With the above construction, the collecting box 110 can be easily separated from the collecting box cap 120 by simply widening the engaging part 124 in both directions using user's two hands. On the contrary, when the collecting box 110 is engaged to the collecting box cap 120, it is needed to simply pull the engaging part 124 inwardly.

In the present invention, a certain alarming unit 200 is further installed so that the stored state is informed to a user when the food remnants are stored in the collecting box 110 by a certain amount (about 50% of the volume of the collecting box). Namely, the alarming unit 200 includes a detection rod 211 which is installed at a lower side of the driving unit 40 opposite to the collecting box 110 to correspond with the lower side of the collecting box 110 and detects the stored amount of the food remnants of the collecting box 110. The alarming unit 200 is designed to alarm to the user when the amount of the food remnants set by the detection rod 211 exceeds a set amount level.

Therefore, when the food remnants are increased in the collecting box 110, the collecting box 110 receives the weight of the food remnants, and the collecting box 110 is rotated in the clockwise direction with respect to the hinge shaft 112 of the collecting box cap 120 hinged with the support part 114, and the lower side of the collecting box 110 pressurizes the detection rod 211, so that the control panel 212 informs the pressurizing state to the alarming unit 200.

According to the present invention, the discharge pipe 130 is made of a smooth rubber material, and the storing unit 100 is eccentrically fixed at the one side of the driving unit 40, so that the collecting box 110 is rotated with respect to the hinge shaft 112 by the weights of the food remnants. The rotational force of the collecting unit 110 pressurizes the detection rod 210, so that the discharge time of the food remnants is informed to the user.

The operation of the advice for treating food wastes according to the present invention will be described.

When food wastes are fed into the feeding port 11 of the housing 10, water is first discharged through the drainage net 21 formed at the upper side of the inner casing 20, and the water passed through the drainage net 21 flows through a space formed between the housing 10 and the inner casing 20 and is discharged to the drainage port 12 formed at a lower side of the housing 10.

When the grinding screw 30 is rotated, the screw protrusion 36 of the grinding screw 30 pushes the drainage net protrusion 21*a*, so that the drainage net is also rotated. At this time, the food wastes attached to an inner surface of the drainage net 21 is detached by the wing 62 of the feeding screw 60, and the remnants attached to an outer surface of the drainage net 21 are removed by the brush 22*c* of the brush member 22*b* installed at an upper side of the drum 22.

The fed food wastes are guided by the wing 62 of the feeding screw 60 having a spiral direction opposite to the spiral direction of the screw wing 31 of the grinding screw 30 and are transferred in the direction of the grinding screw 30. At this time, the fed food wastes are well transferred as the drainage net 21 is rotated when the grinding screw 30 is rotated.

In the case of long-sized food wastes, the long food wastes are cut when the upper end of the screw wing 31 of the grinding screw 30 closely contacts with the lower end of the wing 62 of the feeding screw 60. It is possible to achieve a smooth feeding operation of food wastes because the food wastes are fed after the food wastes are first cut. The food wastes transferred to the grinding screw 30 are well ground by the screw blade 31 and the wall surface blade 22*a* of the drum 22. At this time, since the heights of the wall surface blades 22*a* protruded from the inner surface of the drum 22 are getting lower in the downward direction, the food wastes are ground into smaller pieces while the food wastes are being transferred in the downward direction. The ground food wastes are compressed while the ground food wastes are being transferred to the lowest portion of the dehydration net 23 of the inner casing 20. At this time, the leachate generated from the compressed food wastes is discharged to the drainage port 12 of the housing 10 through the dehydration net 23.

The water fed together with the food wastes is first discharged through the drainage net 21, and the leachate generated from the compressed food wastes is discharged through the dehydration net 23, so that the amount of food wastes discharged through the first discharge hole 13 of the housing 10 is significantly decreased.

Water is dehydrated while the ground food wastes are being compressed and transferred to the lowest end of the dehydration net 23 of the inner casing 20, and the food wastes pass through the second discharge hole 75 of the rotation plate 70. Being guided by the discharge groove 14, the food wastes are discharged to the discharge nozzle 50 through the first discharge hole 13. Even when the lower surface of the rotation plate 70 is slightly worn due to the long time use, since the grinding screw 30 compresses the food wastes in the downward direction, the rotation plate 70, which receives a compressing force, closely contacts with the bottom surface of the housing 10, so that a gap is not formed. In addition, the second brush 71 formed at the edge of the rotation plate 70 is rotated in contact with an outer surface of the dehydration net 23, the net holes of the dehydration net 23 are less blocked by foreign substances.

Since the ground food wastes are compressed by the dehydration net 23, almost water is discharged to the drainage port 12 through the dehydration net holes, and a small amount of the water is flown in the direction of the rotary shaft 32. However, the above small amount of water is discharged through the pressure discharge path 90 passes from the upper side of the waterproof packing 19 to the bottom surface of the housing 10. Therefore, in the present invention, even when the waterproof packing 19 is loosened due to the long time use, water is not leaked in the direction of the deceleration gear 42.

Since the food wastes are guided by the circular discharge groove 14 getting deeper at the lower surface of the housing 10, the food wastes are well discharged.

The food wastes, which are fed into the interior of the discharge nozzle 50 through the first discharge hole 13 of the housing 10 and the inlet hole 51 of the discharge nozzle 50, are temporarily stacked on the upper surface of the support plate 52 installed bellow the inlet hole 51, so that the first discharge hole 13 of the housing 10 and the inlet hole 51 of the discharge nozzle 50 are temporarily blocked. Therefore, the leachate generated from the food wastes is discharged through the dehydration net 23, not through the first discharge hole 13 of the housing 10.

Next, as the food wastes are continuously fed into the discharge nozzle 50 by the grinding screw 30 and the rotation plate 70, the elastic support plate 92 is downwardly bent, so that the food wastes are discharged to the outside through the discharge port 53 of the discharge nozzle 50. When the rotation of the grinding screw 30 is stopped, the inlet hole 51 of the discharge nozzle 50 is blocked in cooperation with an elastic force of the support plate 52.

The discharge nozzle 50 is detachably engaged to a lower surface of the housing 10. With the above construction, even when the first discharge hole 13 of the housing 10 or the inlet hole 51 of the discharge nozzle 50 is blocked by a certain hard foreign substance, and food wastes are not moved in a certain direction, the blocking foreign substances can be easily removed by separating the discharge nozzle 50 from the housing 10.

In addition, even when hard foreign substances are fed into the feeding port 11, the feeding screw 60 is separated from the insertion groove 17 of the feeding port 11 together with the foreign substances which are moved back when the grinding screw 30 is rotated in the reverse direction for thereby achieving an easier removal of the food wastes.

As shown in FIG. 14, the food waste treating device is connected with a lower side of the kitchen sink. The storing unit 100 is installed at an outer side of the grinding and dehydrating unit 2 so that a user can easily approach.

Figure 15A:
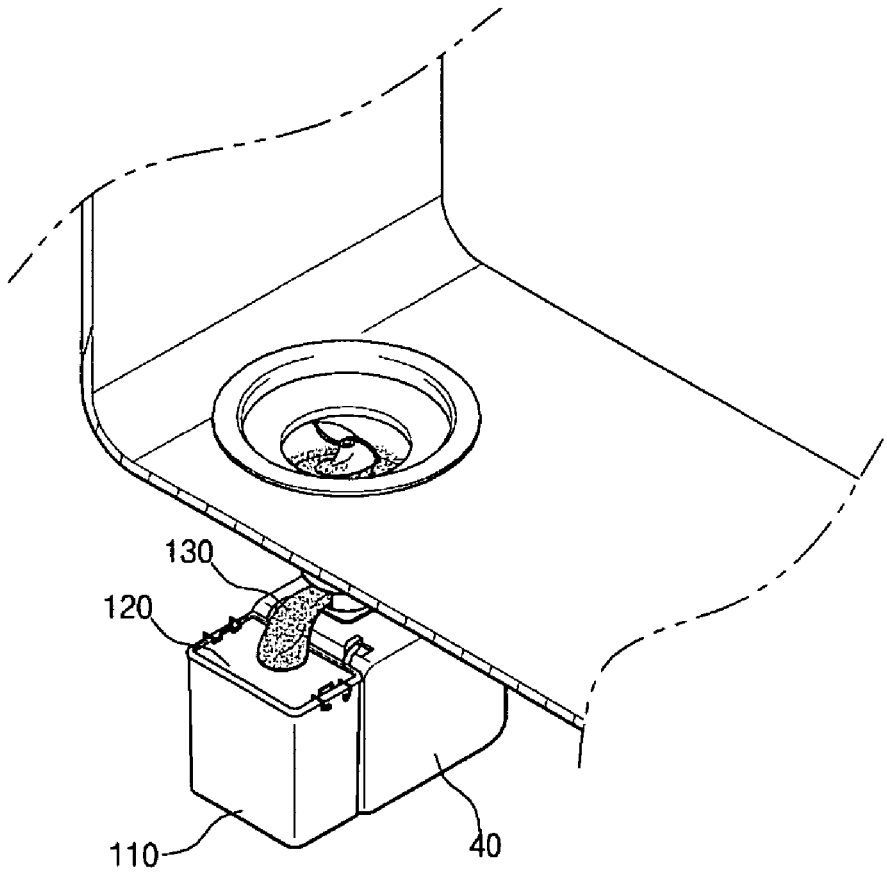
FIGS. 15A through 15D are views illustrating the states of uses of a device for treating food wastes according to the present invention.

As shown in FIG. 15A, when the grinding screw 30 is driven by the driving unit 40, the food remnants discharged from the discharge port 53 of the discharge nozzle 50 is increasingly accumulated in the collecting box 110 through the discharge pipe 130. When the collected amount of the food remnants in the collecting box 110 exceeds a certain amount, the collecting box 110 is sunk downwards by the weights of the stored food remnants. Here, since the collecting box 110 is eccentrically connected with the driving unit 40, the collecting box 110 is rotated in the direction of the detection rod 211 with respect to the hinge shaft 112. As shown in FIG. 12, the detection rod 211 elastically supported by the spring is increasingly pressurized. While the detection rod 211 is being increasingly pressurized, when a signal is inputted from the control panel 212 to the control panel 212, a certain alarming sound is outputted from the alarming unit 200, so that the user recognizes the full storage of the food remnants and removes the stored food remnants.

Figure 15B:
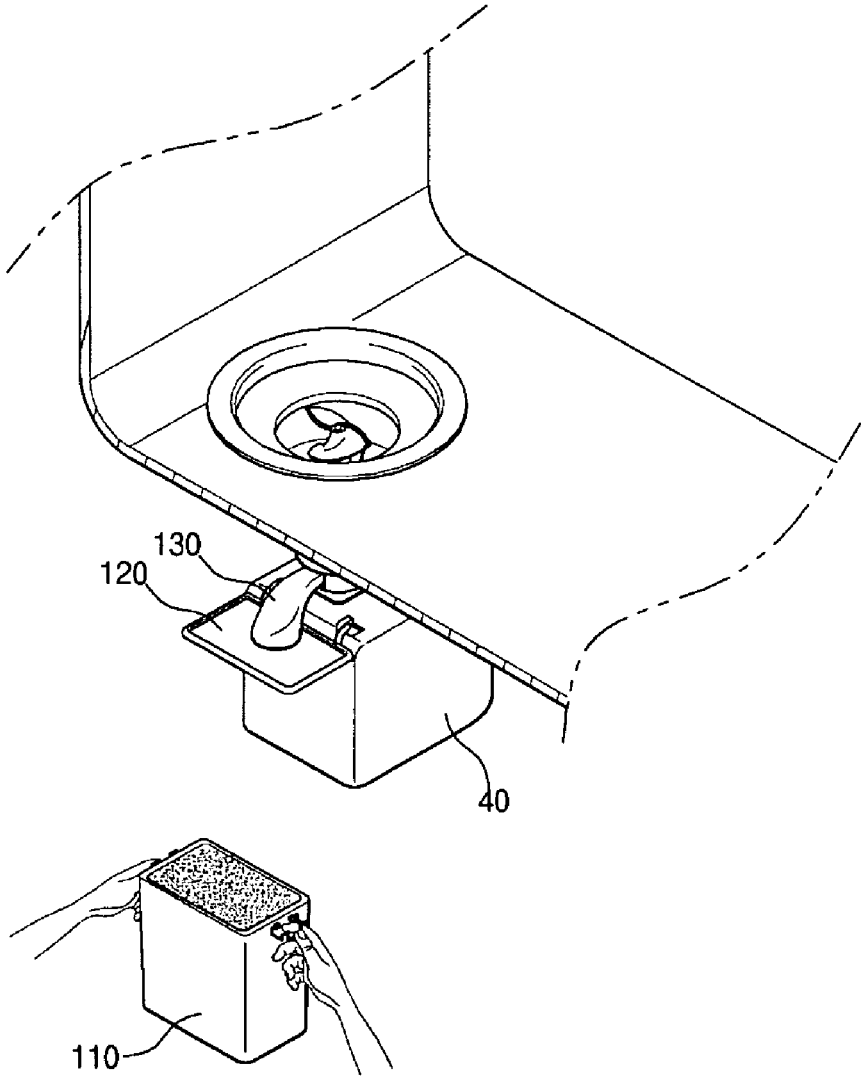
Figure 15C:
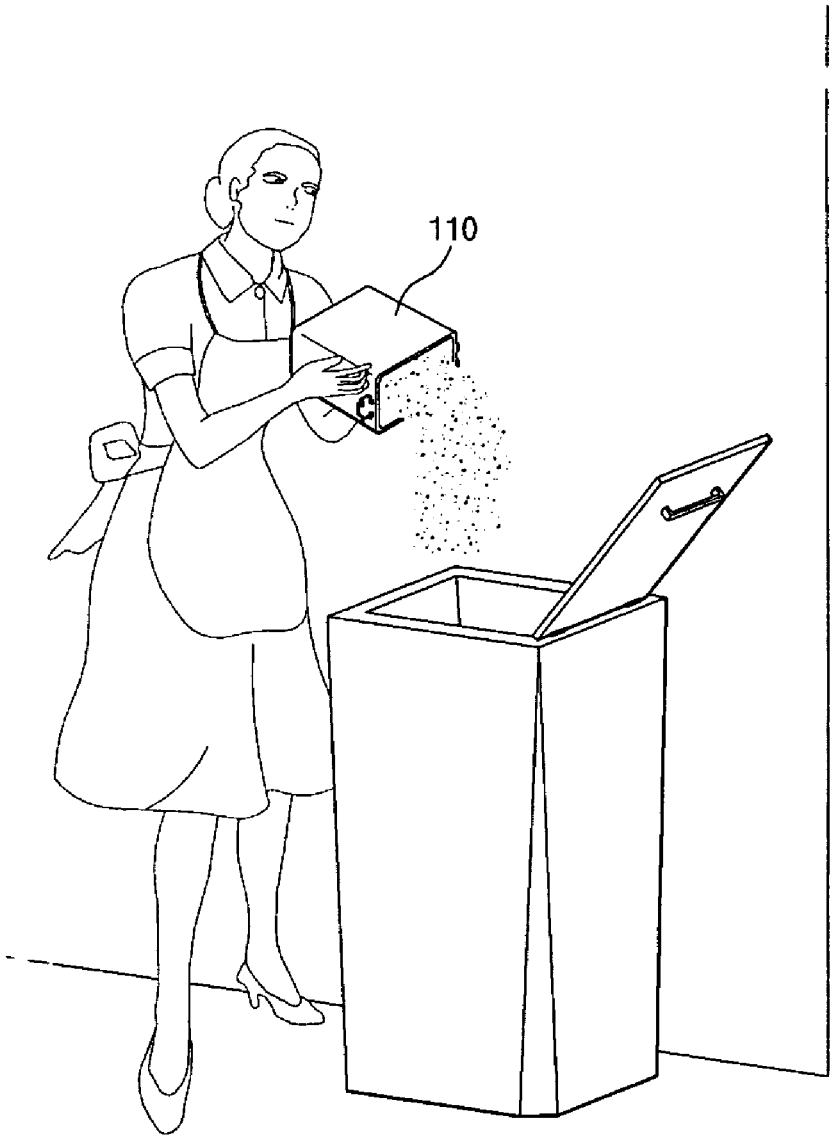

As shown in FIG. 15B, when the user holds the engaging part 124 with both hands and pulls in both directions, the engaging part 124 is disassembled, so that the collecting box 110 is separated from the collecting box cap 120. As shown in FIG. 15C, it is possible to dispose the food remnants of the collecting box 110 into a separate container.

Figure 15D:
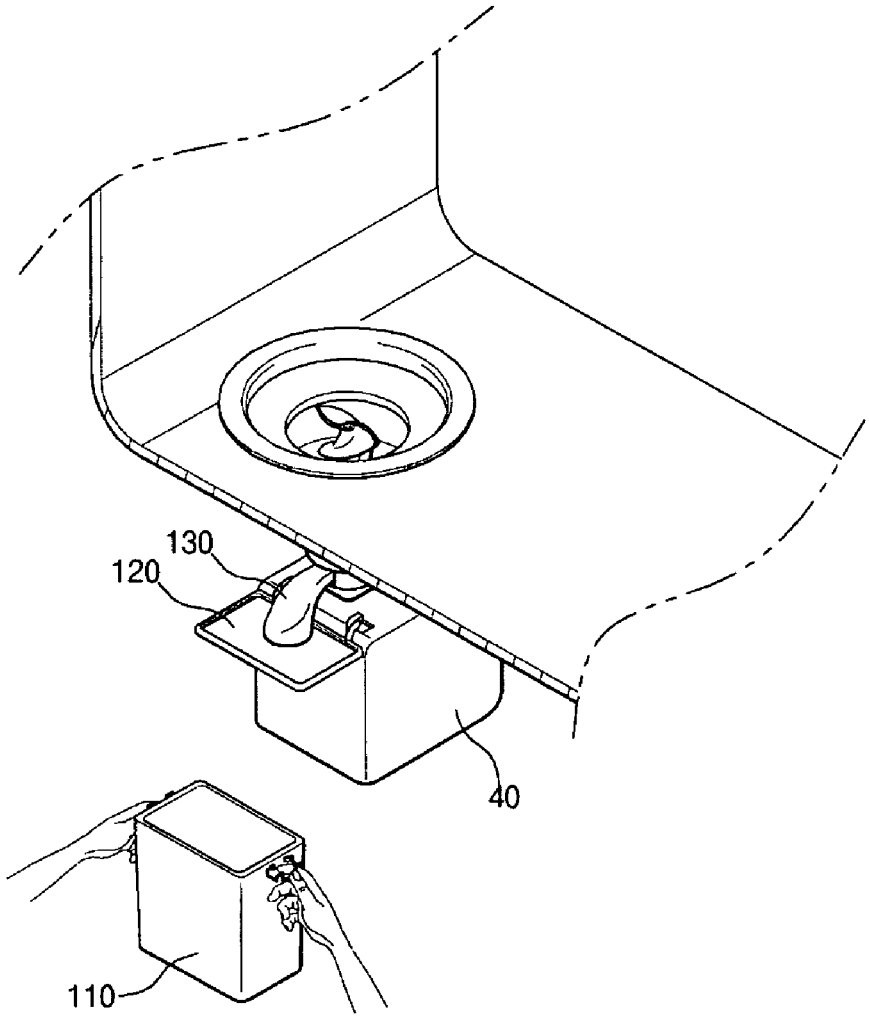

As shown in FIG. 15D, when the user positions the collecting box 110 at the collecting box cap 120 and pushes the same inwards with both hands, the collecting box 110 is attached to the collecting box cap 120, so that the food remnants transferred through the discharge nozzle 50 are sealingly stored.

As described above, the device for treating food wastes according to the present invention has the following advantages.

First, water fed together with the food wastes is first discharged through the drainage net, and the leachate generated from the food wastes is second discharged through the dehydration net. With the above grinding and dehydration operation of the food wastes, the amount of the food wastes is significantly decreased. Therefore, it is enough to remove the collecting box once a week. In the present invention, it is not needed to directly pick up food wastes using hands, dehydrate and move the same as compared to the conventional art, so that a user's long time demand is satisfied.

Second, the feeding screw and grinding screw scratch the remnants caught at the drainage net and the dehydration net as the screw wing rotates in close contact with the drainage net and the dehydration net, so that it is possible to prevent the drainage net and the dehydration net from being blocked.

Third, even when hard foreign substances are fed, the foreign substances are moved back by reverse-rotating the grinding screw 30 for thereby easily removing the fed hard foreign substances. In addition, the maintenance is simple because the screw can be disassembled.

Fourth, water fed together with the food wastes is first discharged through the drainage net, and the leachate generated from the ground and compressed food wastes is second discharged through the dehydration net 23, so that the amount of the food wastes discharged through the discharge hole is significantly decreased.

Fifth, since the discharge nozzle is detachably engaged with the lower surface of the housing, it is possible to easily overcome the blocked state of the discharge hole even when the discharge hole is blocked by hard foreign substances.

Sixth, the lower end of the wing of the feeding screw and the upper end of the wing of the grinding screw cross each other, so that the food wastes guided by the feeding screw is well cut and fed for thereby achieving a first grinding function thereby.

Seventh, as the drainage net is rotated together with the grinding screw, the fed food wastes are well transferred in the downward direction, and the feeding screw and the brush scratch the inner and outer walls of the drainage net for thereby preventing any blocking of the drainage net.

Eighth, water slurry or foreign substances are not attached at the net holes of the drainage net using brush which rotates in contact with the outer wall of the dehydration net.

Ninth, the food wastes are not stuck, and an efficient discharge operation is achieved in such a manner that the rotation plate is installed between the grinding screw and the housing even when the system is sued for long time.

Tenth, water is not leaked into the interior of the deceleration gear by forming a pressure discharge path even when the waterproof packing is loosened.

Eleventh, the device for treating food wastes according to the present invention is simply attached to a lower side of the kitchen sink, so that an additional installation space is not needed, whereby the inner space of the kitchen sink can be efficiently used.

Twelfth, since it is not needed to directly handle the food remnants with hands, a certain sanitary effect is obtained. Thirteenth, the time for removing the stored food remnants is outputted with an alarming light or an alarming sound to the user, so that it is not needed to frequently check the stored amount of the food remnants.

Fourteenth, in the present invention, the stored food wastes can be easily removed by the simple operations that the kitchen sin door is opened, and the engaging part is separated with both hands, and then the collecting box is disassembled, so that the food remnants can be easily removed.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A device for treating food wastes, comprising:

a housing which includes a feeding port formed at an upper side of the same for feeding food wastes, a drainage port formed at one side of a lower surface of the same for discharging leachate separated from the fed food wastes, and a discharge hole formed at the other side of the lower surface of the same for discharging dehydrated remnants among the food wastes;

an inner casing which is installed at a certain distance from an inner wall of the housing and includes a drainage net installed at an upper side for discharging water fed together with the food wastes, a drum which is installed at a center of the same and has a plurality of wall surface blades at an inner circumferential surface, and a dehydration net installed at a lower side of the same for discharging leachate;

a grinding screw which is vertically installed at an inner side of the inner casing and includes a plurality of screw blades installed at an outer circumferential portion and contacting with the plurality of wall surface blades blade of the drum, and the dehydration net, respectively, for transferring the food wastes in a downward direction and grinding, compressing and dehydrating the food wastes as it is rotated, for thereby discharging the dehydrated remnants through the discharge hole of the housing; and a driving means which rotates the grinding screw.

2. The device of claim 1, further comprising:

an inlet hole which is detachably engaged with a lower surface of the housing and communicates with the discharge hole of the housing at an upper side of the same for thereby guiding the dehydrated remnants;

a discharge port which is formed at one side for discharging the remnants to the outside; and a discharge nozzle which is closely contacted with a lower side of the inlet hole at the other side and has a support plate for temporarily supporting the remnants not to move in a downward direction.

3. The device of claim 1 or, wherein a discharge groove is formed at a lower surface of the housing for guiding the dehydrated remnants in a direction of the discharge hole of the housing as the grinding screw is rotated wherein the ends of the discharge groove is connected with the discharge hole of the housing as the depth of the discharge hole is getting deeper.

4. The device of claim 1, wherein the food wastes are ground into small pieces while the food wastes are being moved in a downward direction as the heights of the wall surface blades of the drum are getting lower in the downward direction.

5. The device of claim 1, wherein said grinding screw includes an extrusion bolt hole for extruding the grinding screw wherein the grinding screw is detachably engaged with the rotary shaft of the driving means using a bolt.

6. The device of claim 1, further comprising a feeding screw which is installed in the interior of the drainage net of the inner casing and includes a spiral wing which is formed at an outer circumferential portion and contacts with the drainage net of the inner casing for thereby guiding the fed food wastes in a downward direction of the inner casing.

7. The device of claim 6, wherein a spiral direction of the feeding screw is opposite to the spiral direction of the screw wing of the grinding screw.

8. The device of claim 1, wherein a drainage net protrusion formed at a lower side of the inner surface of the drainage net of the inner casing is engaged with a screw protrusion formed at an upper side of an outer surface of a screw wing of the grinding screw, so that as the grinding screw is rotated, the drainage net is rotated.

9. The device of claim 8, further comprising a brush member which has a brush contacting with an outer surface of the drainage net.

10. The device of claim 1, further comprising a rotation plate which is engaged with a lower surface of the grinding screw for thereby being rotated together with the grinding screw and has a discharge shoulder of the grinding screw, and a second discharge hole formed at a lower side of the discharge shoulder for thereby guiding the dehydrated remnants in a direction of the first discharge hole of the housing.

11. The device of claim 10, wherein when the grinding screw is rotated, the rotation plate is rotated in cooperation with the grinding screw, and a brush contacting with an outer surface of the dehydration net is installed at an edge of the rotation plate so that water slurry or food debris attached to the net holes of the dehydration net are removed.

12. The device of claim 1, wherein a pressure discharge path is formed at an inner bottom surface of the housing so that the pressure generated when compressing and dehydrating the food wastes is discharged through the drainage portion, not inputted into the interior of the driving means.

13. The device of claim 1, further comprising a storing unit which is installed at one side of the grinding and dehydrating unit for storing food remnants ground and dehydrated by the grinding and dehydrating unit; and an alarming unit for detecting the stored state of the food remnants in the storing unit based on the weight of the food remnants and informing a user of the stored state.

14. The device of claim 13, wherein said storing unit includes:

a collecting box which has a certain space therein for storing the food remnants;

a collecting box cap which is detachably engaged at an upper side of the collecting box and seals the collecting box and has a receiving hole formed at one side of the same so that the food remnants pass through; and a discharge pipe which connects the food waste grinding and dehydrating unit and the collecting box cap and guides the food remnants to the collecting box.

15. The device of claim 14, wherein a hinge shaft is installed at one side of the collecting box cap so that the storing unit is connected with the grinding and dehydrating unit and is supported thereby, and said hinge shaft is fixedly caught by a support part formed at an upper side of the driving means.

16. The device of claim 14, wherein said discharge pipe includes an opening so that both sides of the discharge pipe are opened, with an opening of one side being communicated with a discharge port of a discharge nozzle, and with an opening of the other side being communicating with the receiving hole of the collecting box cap, and with the discharge pipe being made of a smooth rubber material.

17. The device of claim 13, wherein said alarming unit includes:

a detector which is installed at one lower side of the grinding and dehydrating unit corresponding to the lower side of the collecting box for detecting the amount of the food remnants stored in the collecting box; and a control panel which is designed to inform a user of the stored state of the food remnants detected by the detector.

* * * * *